United States Patent [19]

Sadwith

[11] 4,126,485

[45] Nov. 21, 1978

[54] MACHINE FOR CLEANING POTS AND PANS

[75] Inventor: Howard M. Sadwith, Colts Neck, N.J.

[73] Assignee: Industrial Washing Machine Corporation, Matawan, N.J.

[21] Appl. No.: 798,353

[22] Filed: May 19, 1977

[51] Int. Cl.[2] ..... B08B 3/02

[52] U.S. Cl. ..... 134/46; 134/49; 134/144; 134/165; 134/200

[58] Field of Search ..... 134/46–47, 134/49, 52, 62, 82–83, 144, 165, 200

[56] References Cited

U.S. PATENT DOCUMENTS

| | | | |
|---|---|---|---|
| 1,559,727 | 11/1925 | Merseles et al. | 134/165 X |
| 1,993,154 | 3/1935 | Elkington | 134/49 X |
| 2,216,388 | 10/1940 | Hampel | 134/47 |
| 2,633,399 | 3/1953 | Haas | 134/165 X |
| 3,625,233 | 12/1971 | Southard | 134/165 |
| 3,706,317 | 12/1972 | Fox et al. | 134/46 X |
| 3,736,948 | 6/1973 | Crosswhite | 134/200 X |
| 3,858,595 | 1/1975 | Schultz et al. | 134/47 |

OTHER PUBLICATIONS

"Industrials C-1 Pot and Pan Washing Machine", *Industrial Washing Machine Corp.* (Submitted Exhibits A & B), Copyright 1973.

*Primary Examiner*—Robert L. Bleutge

*Attorney, Agent, or Firm*—Kenyon & Kenyon, Reilly, Carr & Chapin

[57] ABSTRACT

A machine for cleaning pots and pans wherein the machine is provided with first and second side access doors for permitting flow through movement of a pan/rack system and, in addition, with a switch and alignment means for permitting alignment of unobstructed compartments of the pan/rack system with oscillating spray arms as the pan/rack system is moved between the access doors and for inhibiting oscillation of the spray arms until alignment is reached. In a further aspect of the invention, the machine is additionally provided with a common counterweight and a cable and pulley system for simultaneously operating the two side access doors and a front access door of the machine.

13 Claims, 11 Drawing Figures

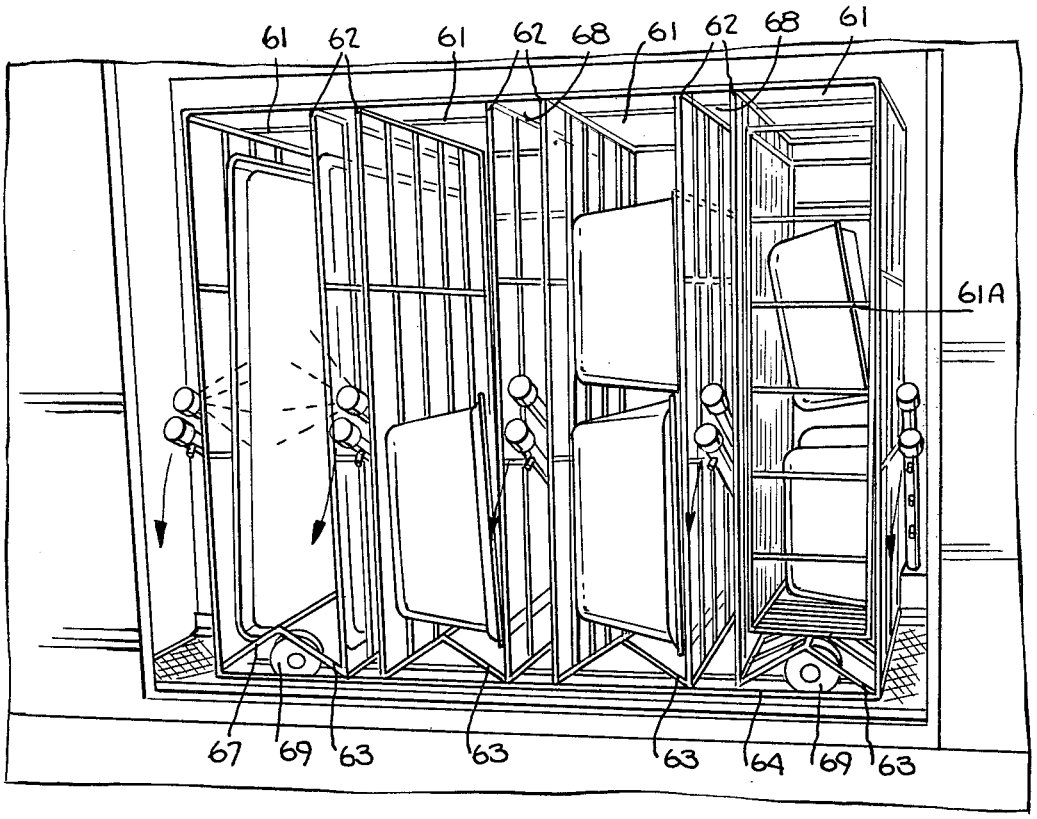
Fig. 10.
Fig. 4.
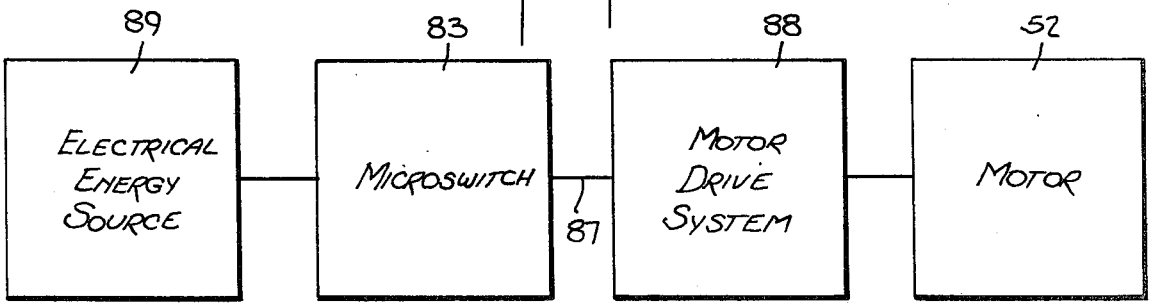

55
54
53
56
51
57
12
60
58
69
14
69
15

MACHINE FOR CLEANING POTS AND PANS

BACKGROUND OF THE INVENTION

1. Field of the Invention

This invention pertains to an article cleaning apparatus and, in particular, to a machine for automatically washing and rinsing pots and pans and other similar articles.

2. Description of the Prior Art

Machines for automatically washing and rinsing articles such as pots, pans, and the like are known in the art. In one type of prior art machine, the machine is constructed from an enclosed housing having a single front access door for providing access to the cleaning chamber formed by the upper portion of the housing. Arranged along the wall of the housing opposite the front door is an oscillating spray header. This header provides both washing and rinsing fluid to pans supported on their narrow sides in a support rack situated on runners disposed in the lower portion of the chamber. The oscillating spray header comprises an elongated, horizontally arranged main header portion which runs parallel to the access door and has first and second pluralities of similarly arranged spray arms spaced along its length. Each spray arm is provided with nozzles having openings which permit fluid to be sprayed in a direction parallel to the length of the main header portion.

The main header portion is supported within the cleaning chamber so as to be rotatable about its longitudinal axis. As a result, oscillation or rotation of the header in the chamber causes the spray arms to trace out arcuate paths and to eject fluid along such paths in opposite directions normal to the planes in which spray arms oscillate.

As above-noted, the pans to be washed are situated on end in a rack which is arranged in the lower portion of the cleaning chamber. The aforesaid rack is divided into compartments each of which supports pans being carried by the rack. Between these pan supporting compartments are situated unobstructed spray arm receiving compartments. Arrangement of the rack is such that the latter compartments are fixed in position relative to the length of the main header portion and are aligned with the spray arms thereof. Oscillation of the header thus causes the spray arms to safely pass into unobstructed rack compartments and to release spray directly onto the flat, large surface areas of the pans supported in the adjacent pan supporting compartments. In this manner cleaning of the pans is realized safely through direct impingement of cleaning fluid on the major solid areas of the pans, thereby greatly facilitating the cleaning operation.

While the above-described prior art automatic washing machine permits enhanced cleaning to be realized, it exhibits certain drawbacks in situations where large volume cleaning at maximum efficiency is desired.

It is, therefore, a primary object of the present invention to provide an improved automatic washing and cleaning machine of the above type.

It is a further object of the invention to provide an improved automatic washing and cleaning machine in which access to the cleaning chamber is facilitated in a manner which permits the machine to be safely operated.

SUMMARY OF THE INVENTION

In accordance with the principles of the present invention, the above and other objectives are accomplished in a machine of the above type by further providing therein two side access doors disposed opposite one another and in planes transverse to the plane of the front access door and, in addition, by also providing therein a switch and alignment means for permitting alignment of the unobstructed rack compartments of the pan supporting rack with the spray arms of the oscillating spray header as the rack is moved between the two side access doors and for inhibiting the oscillation of the spray header until such alignment is reached.

In the embodiment of the invention to be disclosed hereinafter, the switch and alignment means comprises an actuating member which is disposed at least partially in the cleaning chamber of the machine. More specifically, the aforesaid actuating member includes an elongated rotatable member which extends downward into the cleaning chamber and has an arm at its lower end. The latter arm extends into the path between the two side access doors and is arranged to be engaged by an upwardly standing pin or plate carried by the rack. Engagement of the arm by the pin so as to move the arm to a rotated position is indicative of the alignment of the unobstructed rack compartments with the header spray arms.

Such engagement of the arm by the pin also causes a corresponding rotation of the rotatable member, the upper portion of which extends through the upper wall of the cleaning chamber whereat it engages a microswitch which is in the current path of the drive mechanism driving the motor coupled to the oscillating spray header. Rotation of the member, in turn, causes closing of the microswitch and, hence, of the current path feeding the drive mechanism. As a result, the drive mechanism is now free to oscillate the header and such oscillation takes place without obstruction, since the spray arms are now in alignment with the unobstructed rack compartments.

As can be appreciated, continued movement of the rack through the cleaning chamber results in disengagement of the pin of the rack and the arm of the actuating member. The arm, thus, returns to its unrotated position indicating misalignment of the spray arms and the unobstructed rack compartments. Also, the rotatable member will be returned to its unrotated position thereby opening the microswitch and inhibiting oscillation of the header.

In a further aspect of the invention, means is also provided for effecting either a simultaneous opening or closing of the three access doors. This facilitates the loading and unloading operation. In the embodiment disclosed, the aforesaid means is in the form of a counterweight system wherein a common counterweight acts upon the doors simultaneously through a cable and pulley system.

BRIEF DESCRIPTION OF THE DRAWINGS

The above and other features and aspects of the present invention will become more apparent upon reading the following detailed description in conjunction with the accompanying drawings, in which:

FIG. 4 illustrates a block diagram of the electrical current path for the motor driving the oscillating spray header of the machine of FIG. 1;

FIG. 10 illustrates the interior of the machine of FIG. 1 during the cleaning operation.

DETAILED DESCRIPTION

Figure 1:
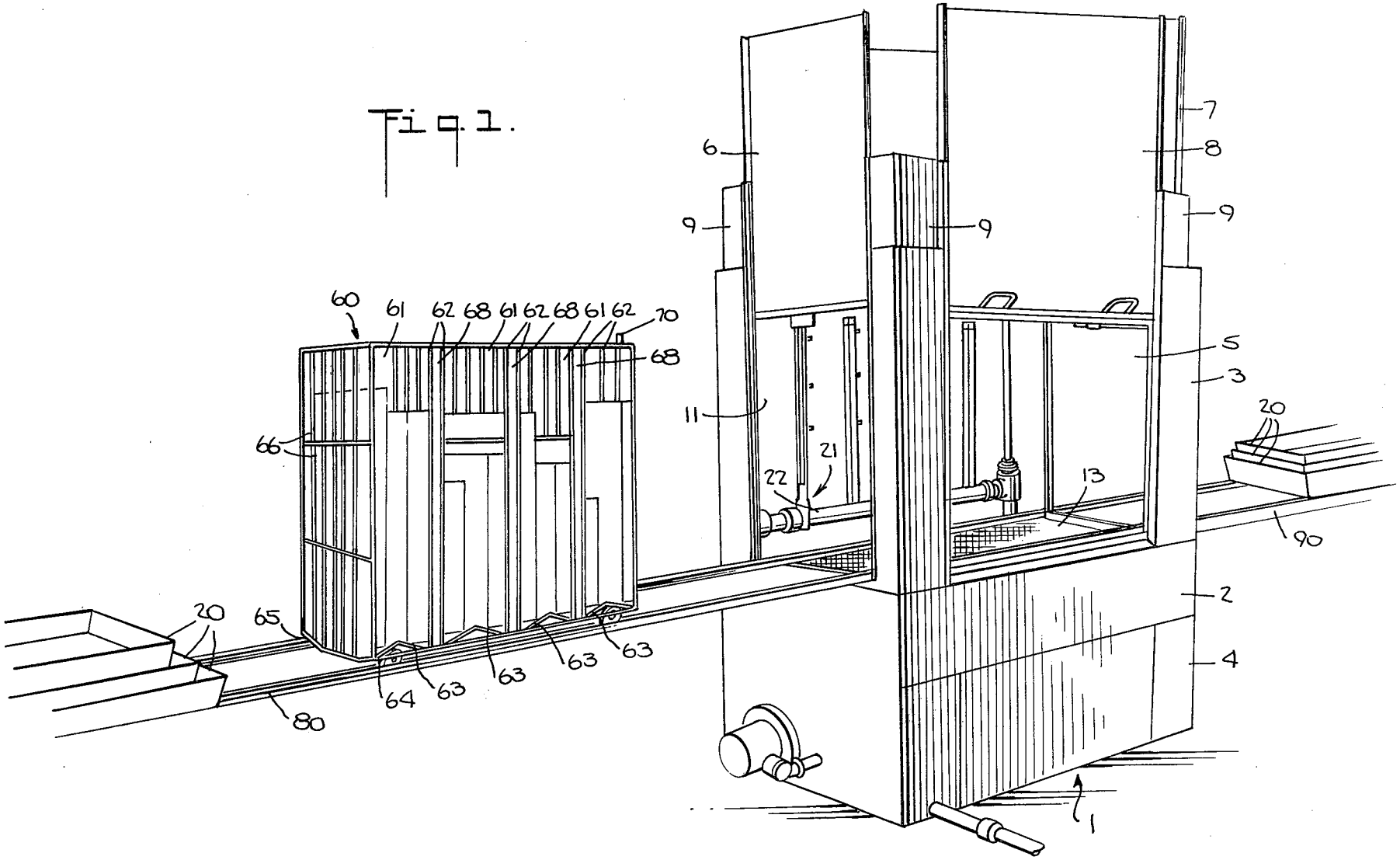
FIG. 1 illustrates an isometric view of a washing and rinsing machine in accordance with the principles of the present invention.

FIG. 1 shows a washing and rinsing apparatus 1 in accordance with the principles of the present invention. The apparatus 1 comprises an outer housing 2 having upper and lower housing portions 3 and 4, respectively. The upper housing portion 3 defines a washing and rinsing chamber 5 and has three access doors 6, 7 and 8 all of which provide access into the chamber 5.

As shown, the access doors 6 and 7 are arranged substantially opposite one another and in planes orthogonal to the plane of the access door 8. The access door 8 permits access to the chamber 5 from the front of the machine 1 and, thus, is referred to as the front access door. Likewise, the access doors 6 and 7 permit access to the chamber 5 from the loading and unloading sides of the machine 1, and, therefore, are referred to as the loading and unloading side access doors, respectively.

As illustrated, the lateral ends of each of the doors 6, 7 and 8 are slidably mounted in respective guide members 9 arranged against the interior walls of the upper housing section 3. The guide members 9 permit the doors 6, 7 and 8 to slide upward through substantially the entire height of the upper housing section 3, thereby affording almost total access to the chamber 5. Further details regarding the operation and functioning of the doors 6, 7 and 8 will be discussed hereinbelow with reference to FIG. 11.

Disposed in the lower portion of the chamber 5 against the rear wall 11 of the upper housing 3 is an oscillating spray header 21. The header 21 comprises an elongated main header portion 22 which extends between the side doors 6 and 7 and is rotatable about its length. As shown more clearly in FIG. 6, extending outwardly from the header portion 22 are a first plurality of spaced hollow spray arms 23 and a second plurality of spaced hollow spray arms 24. The pluralities of spray arms 23 and 24 are similarly spaced along the header portion 22 so that each spray arm 23 lies adjacent to and in front of a respective spray arm 24.

Figure 6:
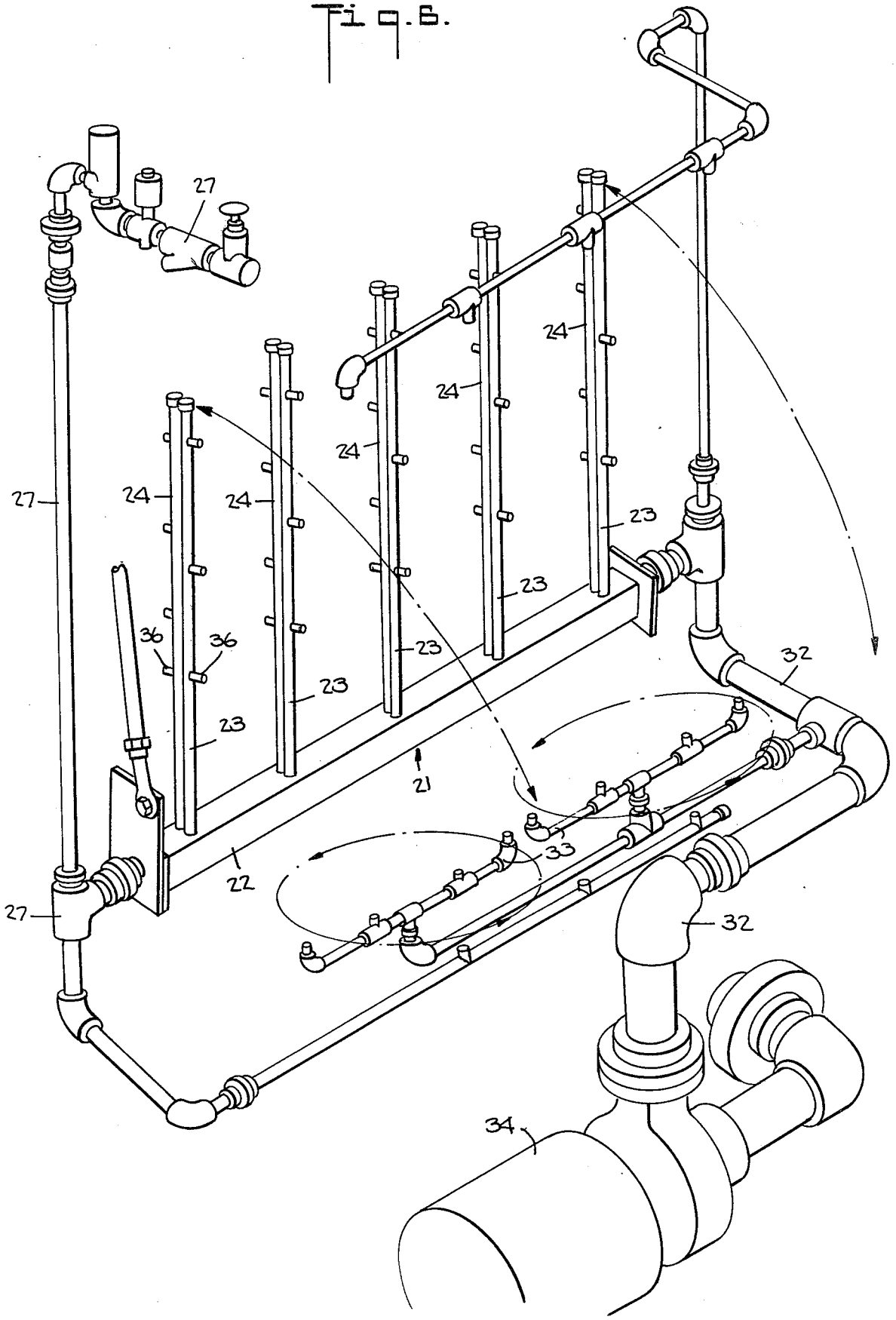
FIG. 6 shows the details of the oscillating spray header of FIG. 1.
Figures 7, 8, 9:
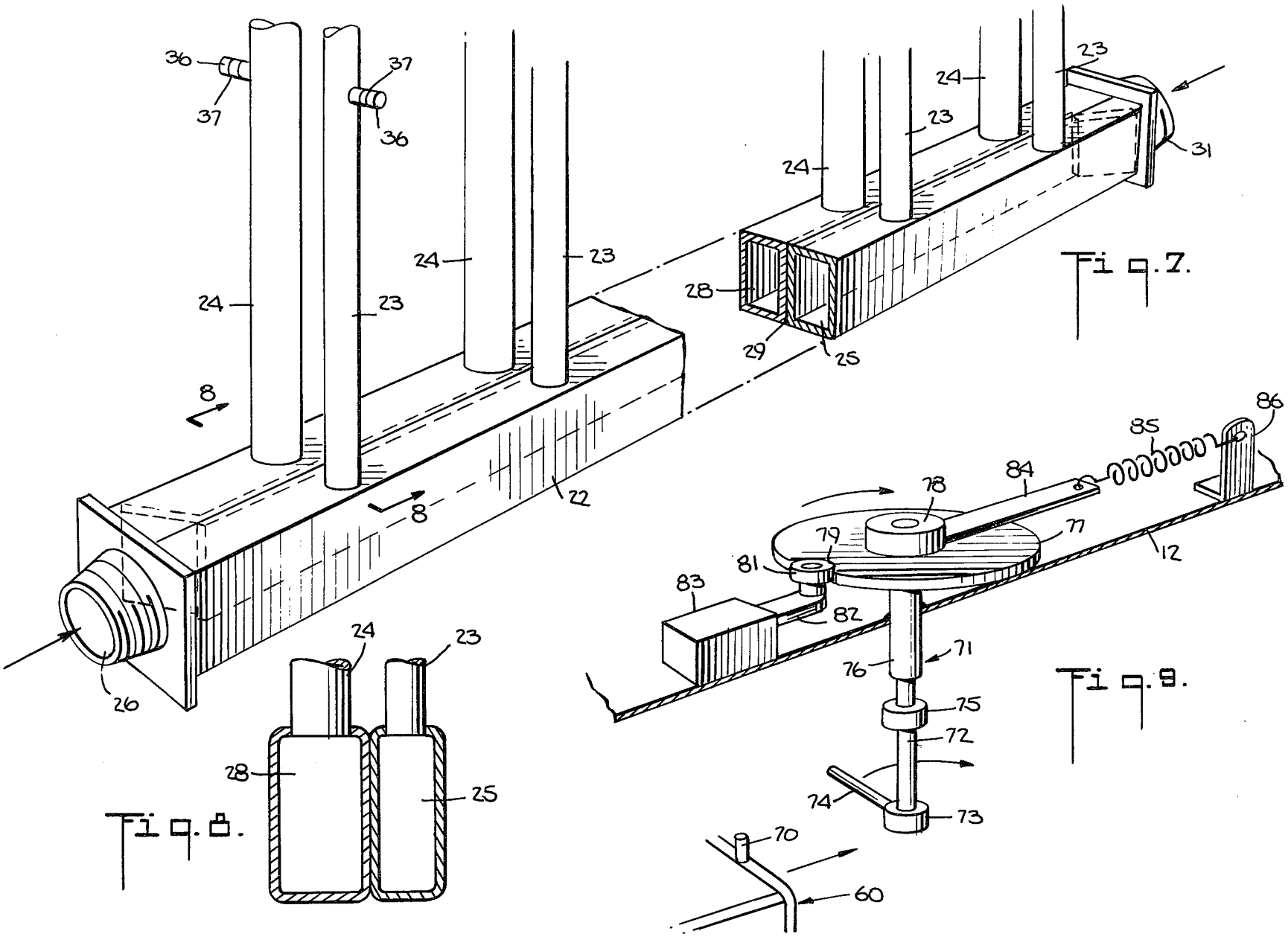
FIG. 7 shows an exploded view of the main header portion and the spray arms of the oscillating spray header of FIG. 6.
FIG. 8 illustrates a cross section of the main header portion of FIG. 7.
FIG. 9 shows the details of the switch and alignment means of the machine of FIG. 1.

The hollow interiors of the spray arms 23 communicate with a first closed channel 25 extending through the header portion 22 (FIGS. 6, 7 and 8). This channel receives rinsing fluid for delivery to the arms 23 from an input opening 26, the latter being in communication with a fresh water delivery piping system 27. Running adjacent the channel 25 in the header portion 22 is a second channel 28. The channel 28 is separated from the channel 25 by a partition 29 and is in communication with the hollow interiors of the spray arms 24. The channel 28 also has an input opening 31 opposite the opening 26 for receiving washing fluid from a washing fluid piping system 32.

Figure 3:
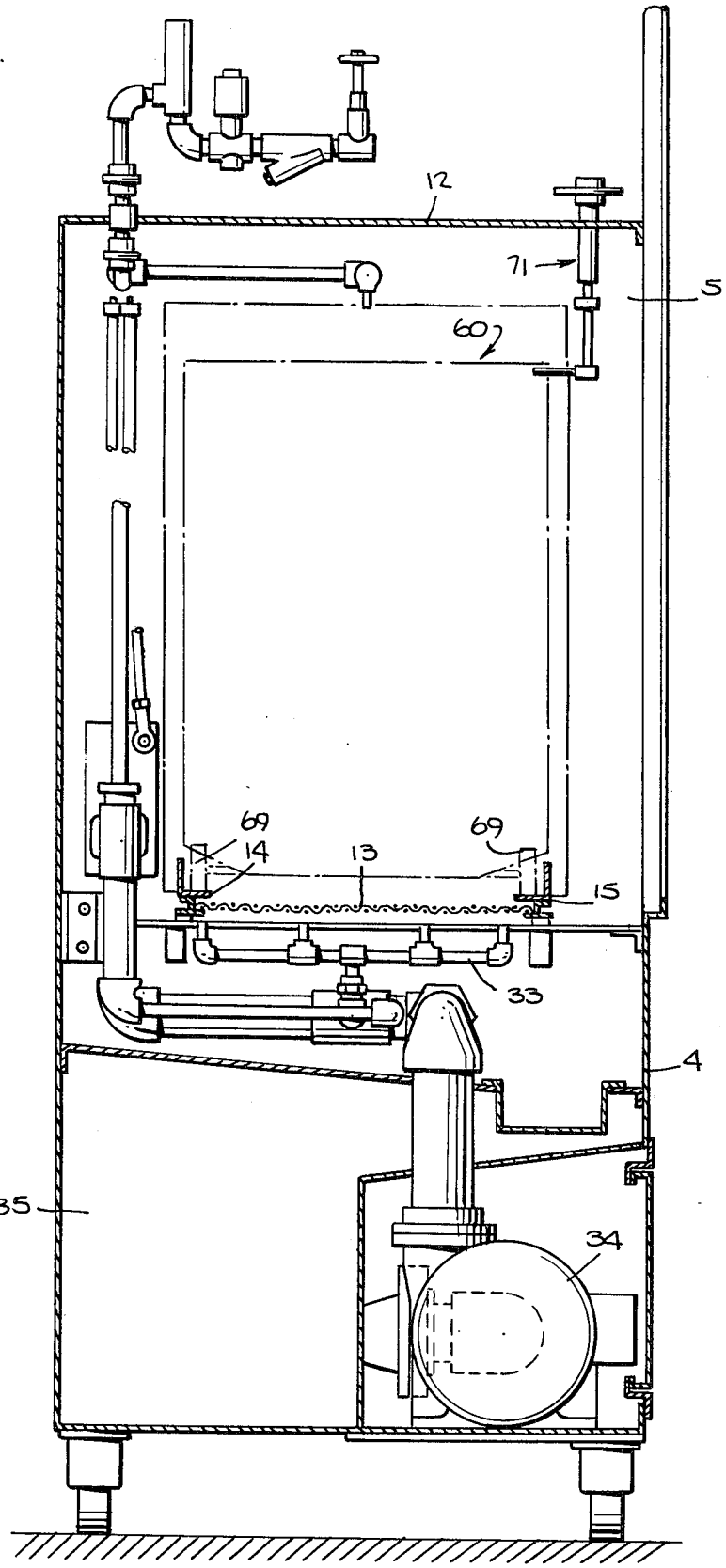
FIG. 3 shows a cross sectional view of the machine of FIG. 1 taken along a plane parallel to the left side access door of the machine.

Piping system 32 also feeds two rotatable headers 33 situated in the upper portion of the bottom housing portion 4. It, in turn, is fed washing fluid by a pump 34 which is situated in the front lower portion of the housing portion 4 and is in communication with a tank 35 situated in the rear of the latter housing poriton (FIG. 3).

Arranged along the length of each spray arm 23 and 24 are pluralities of outwardly extending cylindrical nozzles 36. These nozzles are provided with openings 37 along opposing lateral portions of their cylindrical side walls for ejecting fluid coupled into their respective spray arms in opposite directions parallel to the axis of the main header portion 22 (i.e. toward the opposing access doors 6 and 7). Such fluid ejection takes place during the washing and rinsing operations of the machine 1 which will be discussed in greater detail hereinbelow.

Figure 2:
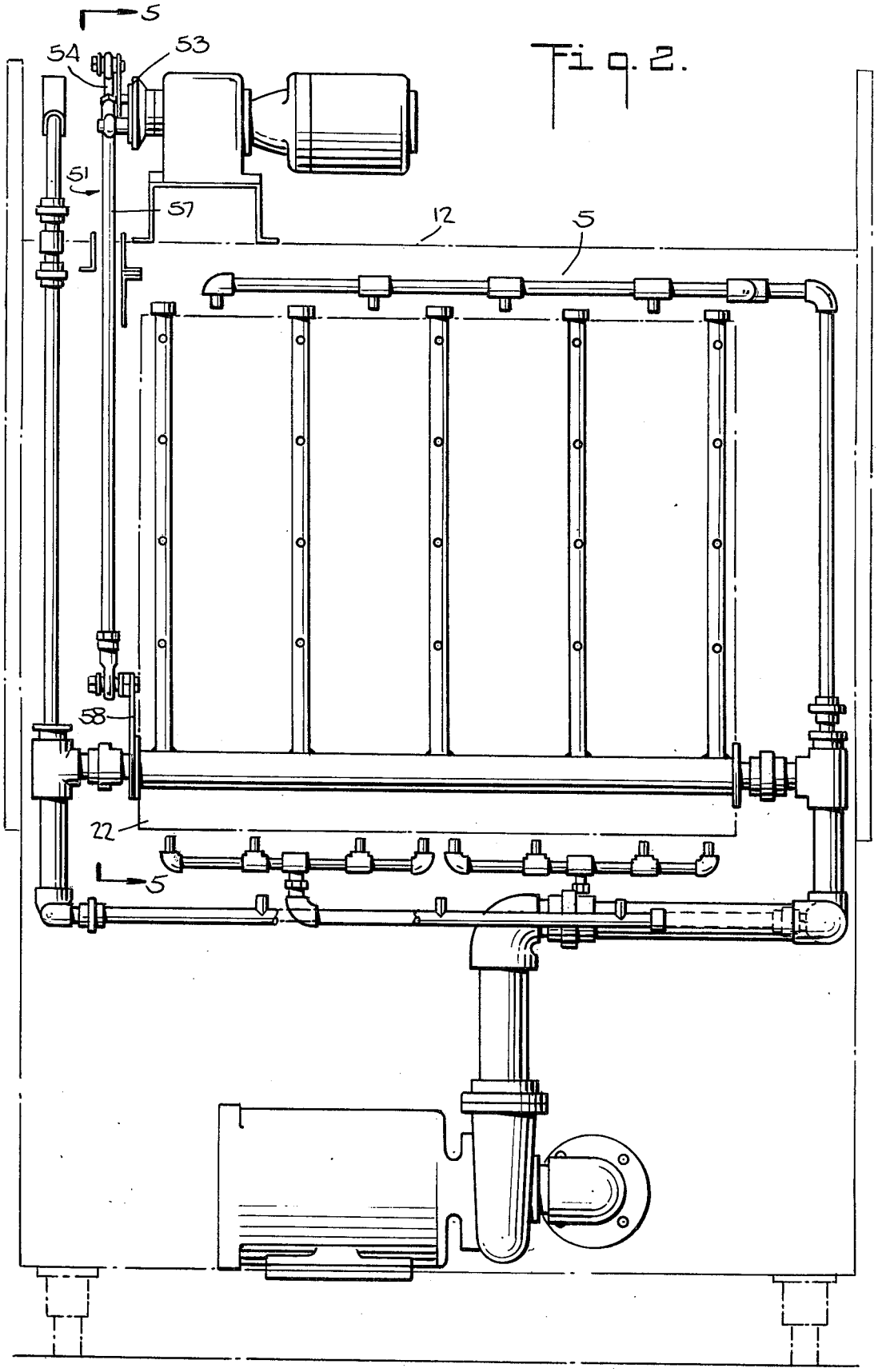
FIG. 2 shows a cross sectional view of the machine of FIG. 1 taken through a plane parallel to the front access door of the machine.

As above-indicated, the header portion 22 is arranged in the chamber 5 so as to be rotatable about its longitudinal axis. In particular, the header portion 22 is driven by a drive mechanism 51 (FIGS. 2 and 5) which causes a substantially 90° rotation of the header portion and, hence, movement of the arms 23 and 24 from a vertical upright position to a horizontal position. The drive mechanism 51 includes a drive motor 52 situated on the outside of the top wall 12 of the chamber 5. A plate 53 is coupled to the drive shaft of the motor 52 for rotation therewith. At a circumferential point of the plate 53, one end of a tie rod 54 is pivotly affixed, the other end of the tie being connected to one end of a lever arm 55. The latter arm is pivotaly connected at its center to a stationary support 56 affixed to the top wall 12 and has its other end connected to a second tie rod 57. The tie rod 57 extends through the wall 12 and couples to a plate 58 which engages the header portion 22 for driving same in the fashion described above, i.e., through a 90° rotation so as to rotate the arms 23 and 24 between the vertical and horizontal positions.

As shown in FIGS. 1 and 10, the machine 1 is also provided with a rack 60 for holding the articles, shown as pans 20, to be cleaned by the machine in the washing and rinsing chamber 5. The rack 60 is divided along its length into a plurality of spaced compartments 61 each of which carries one or more of the pans 20. The compartments 61 are each defined by two substantially open side walls 62 spaced along the length of the rack and a triangular shaped substantially open bottom wall 63 extending between the side walls. Each of the side walls 62 extends transversely between two transversely spaced longituindally extending bottom rails 64 and 65 which define the bottom of the rack. Each wall 62, moreover, is formed by vertically and transversely extending thin bars 66 formed into a mesh configuration. Each of the bottom walls 63, in turn, also extends transversely between the rails 64 and 65 and each is formed from thin spaced triangular bars 67.

Situated between each adjacent pair of pan holding compartments 61 is an unobstructed spray arm receiving compartment 68. The compartments 68 form a second plurality of compartments in the rack 60 and are aligned with and permit unrestricted oscillation of the spray arms 23 and 24 when the rack 60 is appropriately situated in the chamber 5.

Figure 5:
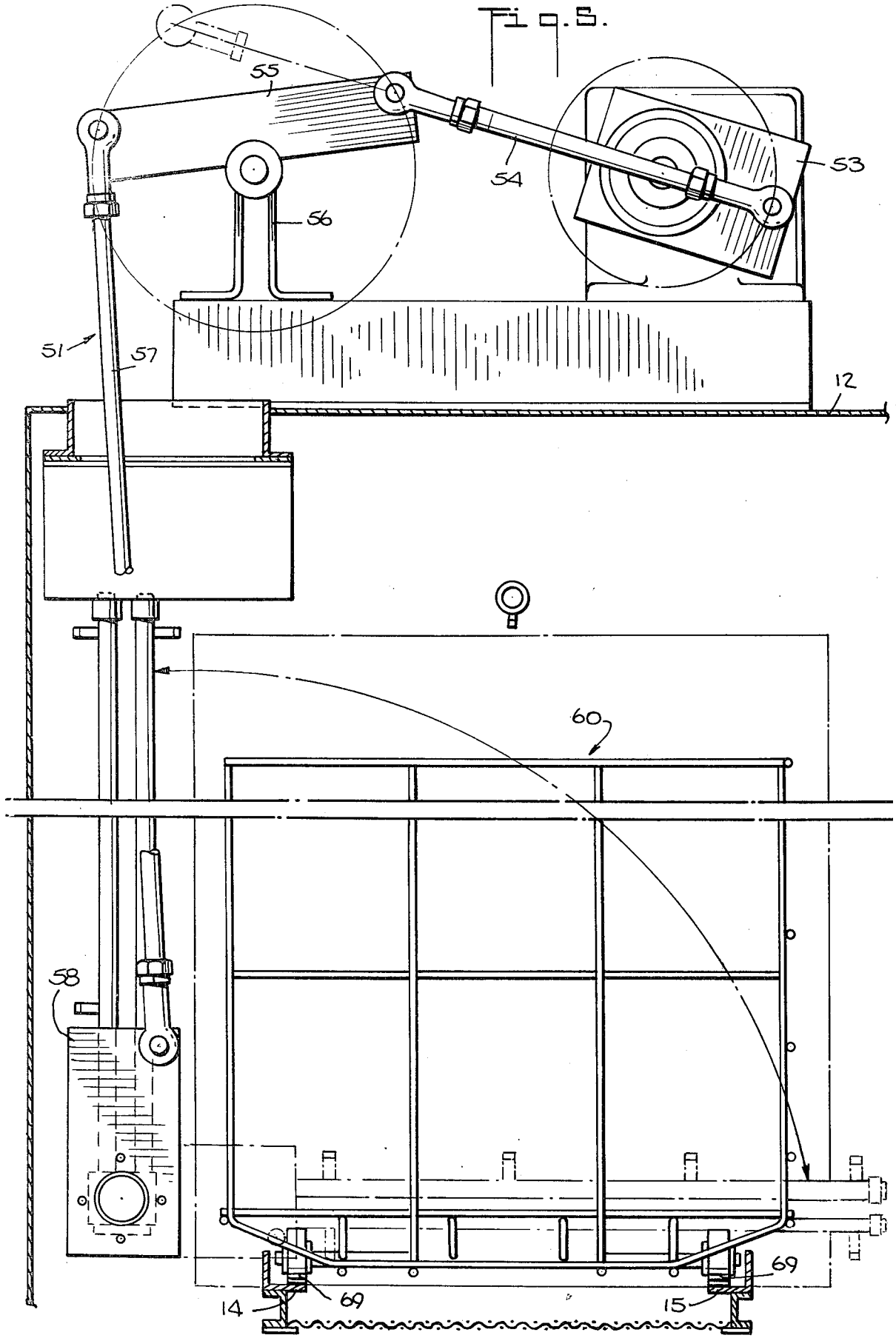
FIG. 5 illustrates the mechanical drive arrangement for controlling the spray header of the machine of FIG. 1.

As can be seen in FIG. 1, the rack 60 is situated on a loading table 80 upon which the pans 20 for loading into the rack have been placed. After loading of the rack 60, the rack is moved into the chamber 5 and supported therein on a chamber support 13 situated at the bottom of the chamber 5 and comprising two transversely spaced guide rails 14 and 15 (FIGS. 3 and 5). To facilitate transverse alignment of the rack within the chamber, the rack is provided with 2 pairs of transversely spaced wheels or rollers 69. These pairs of rollers are supported on the outer surfaces of the triangular walls 63 of the first and last tray support compartments 61 and engage and are guided by the rails 14 and 15 of the bottom support 13.

As can be appreciated, in order for the machine 1 to be safely operated during the positioning of rack 60 in the chamber 5, the oscillating spray header 21 must remain immobile during the movement of the rack 60 into the chamber and until the rack is positioned along the rails 14 and 15 at a position in which the unobstructed spray arm receiving compartments 68 are aligned with the pairs of spray arms 23 and 24. By maintaining the header immobile during the latter operation injury to the operator due to an accidental turning on of the machine is prevented. Also prevented is damage to the machine parts due to jamming which might result from starting the machine with the compartments 68 out of alignment with the spray arms.

In accordance with the principles of the present invention, the machine 1 is thus provided with a means which ensures that the aforesaid alignment condition of the rack is met and in the meantime inhibits operation of the spray header 21. More particularly, the machine 1 is provided with an alignment and safety switch means 71, (See FIGS. 3 and 9) a portion of which protrudes into the chamber 5 so as to be responsive to the condition of the rack 60 in which the compartments 68 of the rack are aligned with the spray arms 23 and 24 of the header 21.

As shown in detail in FIG. 9, the switch means 71 comprises a central rotatable rod 72 which extends vertically downward from above the upper housing wall 12 of the chamber 5. At the lower end of the rod 72 is fixedly arranged a cylindrical collar 73 from which protrudes a rod or arm 74. The arm 74 protrudes transversely into the chamber 5, and is of sufficient length to lie in the path of the rack 60.

More particularly, in accord with the invention, the rod 72 and arm 74 are positioned in the chamber 5 so that the arm 74 is engaged and the rod 72 rotated when the compartments 68 of the rack 60 are in an aligned condition relative to spray header arms 23 and 24. In the particular case shown, this is accomplished by disposing the rod 72 such that when the rack is in the aforesaid aligned condition the arm 74 is engaged and rotated by an upwardly standing pin or plate 70 carried by the rack 60. As shown, the pin 70 extends upwardly above the other portions of the rack 60 so that it is the only portion of the rack which can engage and rotate the arm 74.

Above the collar 73, the rod 72 extends through a cylindrical collar 75 and through a cylindrical pipe 76 arranged above the collar and supported by the wall 12. The pipe 76 protrudes above the wall 12 and terminates at a flat cylindrical disk 77 which, in turn, supports a terminating collar 78. The disk 77 and collar 78 also have bores which receive the upper end of the rod 72, which end terminates at the upper end of the collar 78.

The disk 77 has a semicircular cutout 79 at a region along its circumference. Seated within the cutout 79 is a cylindrical disk 81 which is affixed to a switch control arm 82 of a microswitch 83, the latter being supported on the outer surface of the wall 12. Disposed diametrically opposite to the cutout 79 and supported on and fixedly attached to the upper surface of the disk 77 is a radially extending bar 84. At the end of this bar, a tension means in the form of a spring 85 extends outwardly and terminates at a post 86 which is also fixedly attached to the top surface of the wall 12.

As indicated schematically in FIG. 4, the microswitch 83 of the switch means 71 is arranged in series with the current path 87 in the machine 1, which current path feeds current from a source 89 to the motor drive system 88 driving the oscillating header drive motor 52. With the condition of the switch means 71 as shown in FIGS. 3 and 9, i.e., with the arm 74 extending into the chamber 5 directly toward the header 21, thereby holding the disk 77 in the cutout 51 of the disk 77, the contacts of the microswitch 83 are open so that the current path 87 is open and no current is being fed to the drive system 88. Thus, in this condition of the switch means 71, the oscillating spread header 21 is inhibited from oscillating and remains immobile.

The aforesaid condition of the switch means 71 persists as the rack 60 is moved along the rails 14 and 15 into the chamber 5. When the rack 60 arrives at a position whereat its compartments 68 are aligned with the spray arms 23 and 24 of the header 21, the upwardly extending pin 70 of the rack engages the arm 74 so as to rotate the latter and, in turn, the rod 72. Rotation of the rod 72 causes the disk 77 to rotate and its cutout portion to push or activate the disk 81 and arm 82 of the microswitch 83. This action closes the contacts of the switch so that the current path 87 leading to drive system 88 is now closed. Current can now be delivered to the drive system during the subsequent washing and rinsing cycles of the machine 1 without worry of interaction between the header spray arms 23 and 24 and the rack 60 and pans 20.

FIG. 10 illustrates the interior of the machine 1 subsequent to the rack being automatically aligned in the chamber 5 by moving the pin 70 of the rack 60 into engagement with the arm 74 and during one of the operating rinsing and washing cycles of the machine. As can be seen, the spray arms 23 and 24 oscillate unobstructed downward and upward through a substantially 90° arc within the compartments 68 of the rack 60. During this movement, fluid 38 (either washing fluid or rinse fluid) is continuously ejected in directions orthogonal to the large flat surfaces of the pans 20 in the compartments 61. Thus, the fluid directly impinges on the surfaces to be cleaned, thereby greatly facilitating the cleaning and rinsing processes. Also shown in FIG. 10 is the use of a separate cage support structure 61A which is used to support pans of smaller size and which is directly inserted into the first pan support compartment 61.

After the machine 1 completes the cleaning cycle, the rack 60 is moved through the chamber 5 and out the unload access door 7 onto an unloading table 90 where the pans 20 are unloaded. When the rack 60 is moved so that the pin 70 disengages the arm 74, the latter is released. This, in turn, causes the contacts of the microswitch to again open thereby also again opening the current path 87 and immobilizing the header 21. More particularly, when arm 74 is engaged by the pin 70 so as to rotate the rod 72, the rod 72 not only pushes the disk 81, but additionally rotates the rod 84 attached to the disk 77. Such rotation thus places the spring 85 under tension. When the pin 70 disengages and, hence, releases the arm 74, the spring 85 returns to its original state. The arm 84 and disk 77 are thereby counterrotated and the disk 81 is pushed so it again is seated within the cutout 79. This, in turn, returns the arm 82 to its original position and the contacts of the microswitch 83 are again opened.

As can be appreciated, the space defined by the unobstructed rack compartments 68 for passage of the header spray arms 23 and 24 is of greater extent than the diameter of the arms. As a result, alignment of the compartments 68 with the spray arms occurs for a range of positions of the rack 60 along the path between the side access doors 6 and 7. In situations where maximum leeway in positioning of the rack is desired, the switch and alignment means can be constructed so that a slight rotation of the arm 74 by the pin 70 corresponds to the beginning of the alignment condition and results in actuation of the microswitch 83 and such that maximum rotation of the arm 74 just prior to disengagement by the pin 70 corresponds to the end of the alignment condition. Similarly, where less leeway in positioning the rack is permitted, the switch and alignment means can be adjusted so that a substantially greater rotation of the arm 74 by the pin 60 is required before the rotation results in actuation of the microswitch 83.

Having described in detail the operation and construction of the alignment and safety switch means 71 of the machine 1, attention will now be directed to the operation and construction of the machine mechanism for operating the access doors 6, 7 and 8. More particularly, in accordance with a further aspect of the invention, a mechanism is provided for causing simultaneous opening and closing of all access doors. In the present illustrative example, the aforesaid mechanism is designed so that activation of the front access door 8, which is the larger of the three doors, will result in activation of the side access doors 6 and 7. Alternatively, the mechanism 91 can also be designed so that activation of any one of the access doors results in activation of the other two.

Figure 11:
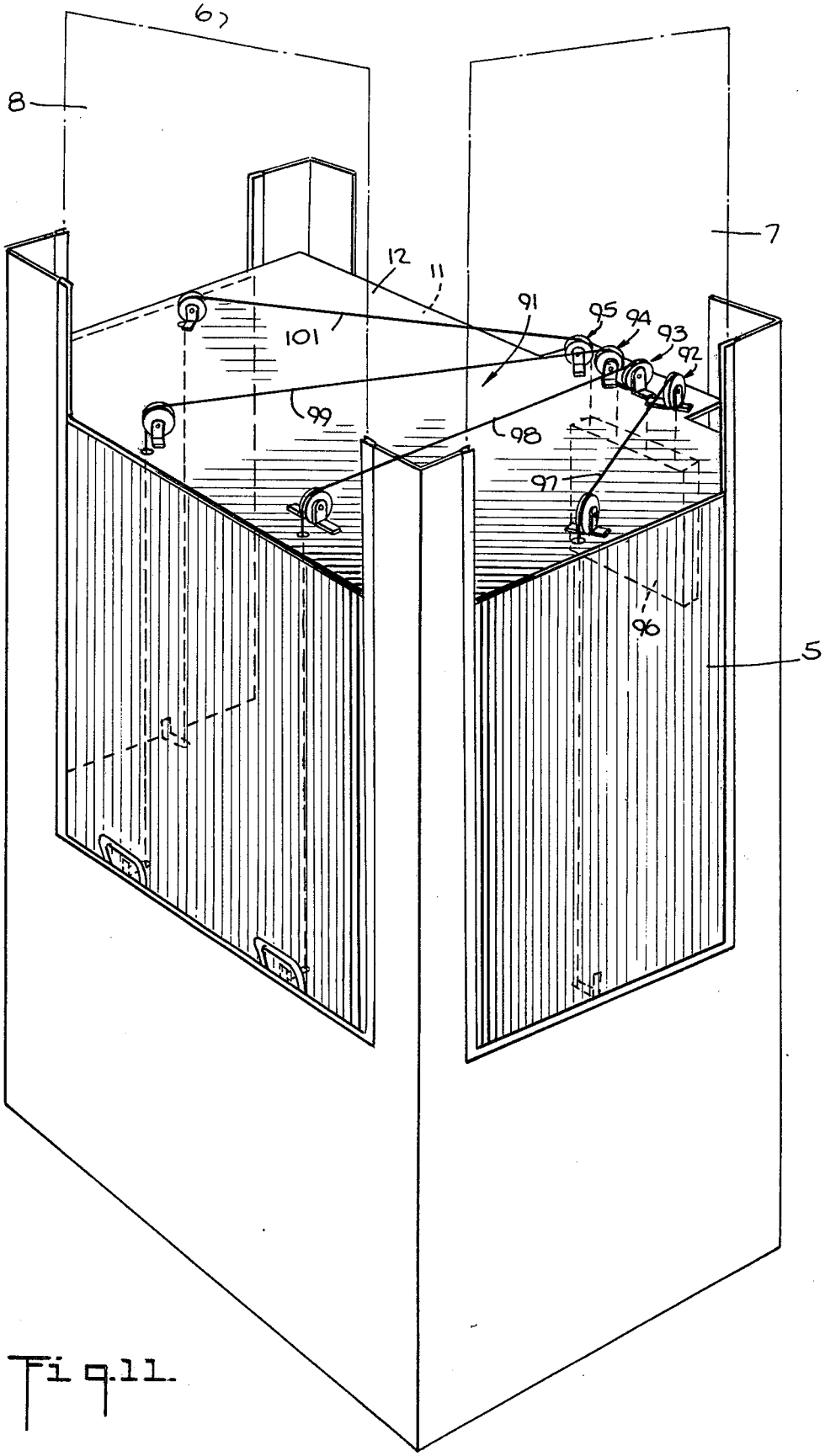
FIG. 11 illustrates the counterweight and pulley mechanism for simultaneously operating the access doors of the machine of FIG. 1.

FIG. 11 shows the mechanism 91 for providing simultaneous movement of the side access doors 6 and 7 upon activation of the front access door 8. Mechanism 91 comprises pairs of pulleys 92, 93, 94 and 95 mounted on the outer surface of the top wall 12 of the chamber 5. The pulley pairs 92 and 95 are associated with the side access doors 6 and 7 and each has one pulley disposed centrally adjacent its respective access door and the other adjacent the outer surface of the rear wall 11 of the chamber 5. The pulley pairs 93 and 94, in turn, are each associated with the front access door 8. Each of these pullely pairs has one of its pulleys arranged adjacent an end of the door 8 and the other adjacent the rear wall 11.

Each of the pullely pairs 92 to 95 provides a guide means for a cable running from a counterweight 96 located adjacent the outer surface of the rear wall 11 to an eye bolt secured to the interior wall of its respective door. Thus, cables 97 and 101 guided by the pulley pairs 92 and 95 connect the counterweight 96 to the side access doors 7 and 6, respectively. Likewise, the cables 98 and 99 through pulley pairs 93 and 94 connect the counterweight to the front access door 8.

The counterweight of the mechanism 91 is selected so that an equilibrium condition is just maintained between it and the three access doors 6, 7 and 8. Activation of the front access door 8 upward disturbs this equilibrium condition and causes the weight 96 to move downward to reestablish equilibrium. Such movement increases the force exerted by the weight 96 on cables 97 and 101, thereby causing the access side doors 6 and 7 to rise to the level of the front access door 8. Thus, movement of the access door 8 upward is simultaneously accompanied by movement upward of the side access doors 6 and 7. Similarly, movement downward of the door 8 is accompanied by a movement downward of the doors 6 and 7.

The mechanism 91, thus, permits simultaneously upward and downward movement of the three doors 6, 7 and 8 of the machine 1. Such operation decreases the time required to move the rack 60 into and out of the chamber 5, whereby faster and more efficient cleaning of the pans 20 carried by the rack 60 is realized.

In all cases, it is understood that the above-described arrangements are merely illustrative of the many possible specific embodiments which represents applications of the invention. Numerous and varied other arrangements can readily be devised without departing from the spirit and scope of the invention.

What is claimed is:

1. A machine for cleaning pans, said pans being adapted to be supported in the machine on an elongated rack having along its length a first set of compartments for receiving said pans and a second set of compartments each being substantially unobstructed and disposed between adjacent ones of said first plurality of compartments, the machine comprising:

a housing having an enclosed chamber for receiving said rack, said housing including a front access door and first and second side access doors for providing access to said chamber, said first and second access doors being disposed opposite one another and transverse to said front access door;

means for providing washing and rinsing fluid within said chamber, said means including oscillating spray header means having a main header portion rotatably disposed within said chamber opposite said front access door, said header portion having along its length similarly distributed adjacent first and second pluralities of spray arms extending outward therefrom in the direction of said front access door;

and switch and alignment means for permitting alignment of said second set of rack compartments with said spray arms as said rack is moved through said chamber between said first and second access doors and for inhibiting oscillation of said spray header until alignment is reached.

2. A machine in accordance with claim 1, wherein: said rack has a first portion which extends beyond the remaining portions of the rack and said switch and alignment means includes an actuating member disposed within said chamber for engaging said first rack portion.

3. A machine in accordance with claim 2, wherein:

said spray header means includes electrical drive means for driving said main header portion, said drive means being adapted to be responsive to the current from an electrical source;

and said switch and alignment means includes electrical switch means responsive to said actuating member for controlling the current being delivered from said source to said electrical drive means.

4. A machine in accordance with claim 3, wherein:

said actuating member comprising an elongated bar rotatably mounted on said housing and extending downward into said chamber, and an arm extending from the lower end of said bar into said chamber transverse to the path between said first and second side access doors.

5. A machine in accordance with claim 4, wherein said first rack portion includes an upwardly standing pin and wherein:

said elongated bar is situated in said chamber so that said upwardly standing pin is brought into engagement with said arm so as to rotate said arm when said second set of rack compartments are aligned with said spray arms.

6. A machine in accordance with claim 4, wherein:

said electrical switch means is responsive to said rotation of said bar.

7. A machine in accordance with claim 6, wherein:

said electrical switch means comprises a microswitch and means for coupling said microswitch to the upper end of said bar.

8. A machine in accordance with claim 7, wherein:

said upper end of said bar extends outside the upper wall of said chamber;

and said microswitch is disposed outside said chamber and on said upper wall.

9. A machine in accordance with claim 1 further comprising:

means for simultaneously operating all said access doors.

10. A machine in accordance with claim 9, wherein:

said access doors are slidably mounted on said housing;

and said means for simultaneous operating includes a counterweight and means for connecting each of said access doors to said counterweight.

11. A machine in accordance with claim 10, wherein:

said means for connecting includes for each said access door a pair of pulleys one of which is arranged adjacent its respective access door and the other of which is arranged adjacent said counterweight.

12. A machine in accordance with claim 11, wherein:

said counterweight is disposed on the outside of said housing adjacent said rear wall;

and said means for connecting further includes for each said access door a cable guided by the pulleys corresponding to that door and connected to that door and said counterweight.

13. A machine in accordance with claim 10, wherein:

said counterweight maintains an equilibrium condition with said access doors.

* * * * *

UNITED STATES PATENT AND TRADEMARK OFFICE

CERTIFICATE OF CORRECTION

PATENT NO. : 4,126,485

DATED : November 21, 1978

INVENTOR(S) : Howard M. Sadwith

It is certified that error appears in the above-identified patent and that said Letters Patent are hereby corrected as shown below:

Col. 4, line 17, change "poriton" to --portion--

Col. 4, line 41, change "pivotly" to --pivotally--

Col. 4, line 43, change "pivotly" to --pivotally--

Col. 4, line 62, change "longituindally" to --longitudinally--

Col. 6, line 26, change "51" to --79--

Col. 7, line 62, change "pullely" to --pulley--

Col. 7, line 65, change "pullely" to --pulley--

Signed and Sealed this

*Eleventh* Day of *March 1980*

[SEAL]

*Attest:*

SIDNEY A. DIAMOND

*Attesting Officer*

*Commissioner of Patents and Trademarks*